US005481849A

United States Patent [19]

Spatafora

[11] Patent Number: 5,481,849

[45] Date of Patent: Jan. 9, 1996

[54] OPERATING UNIT FOR HANDLING MOVING PRODUCTS

[75] Inventor: Mario Spatafora, Bologna, Italy

[73] Assignee: Azionaria Construzioni Macchine Automatiche A.C.M.A. S.p.A., Bologna, Italy

[21] Appl. No.: 187,514

[22] Filed: Jan. 28, 1994

[30] Foreign Application Priority Data

Feb. 24, 1993 [IT] Italy ..... BO93A0064

[51] Int. Cl.[6] ..... B65B 7/12; B65B 51/00; B65B 11/34

[52] U.S. Cl. ..... 53/370; 53/227; 53/234

[58] Field of Search ..... 53/217, 227, 370, 53/225, 234; 198/377, 475.1; 493/308, 943

[56] References Cited

U.S. PATENT DOCUMENTS

| | | | |
|---|---|---|---|
| 3,899,865 | 8/1975 | Revaz | 53/370 X |
| 3,987,605 | 10/1976 | Johnson | 53/370 X |
| 4,220,237 | 9/1980 | Mohn | 198/377 |
| 4,413,709 | 11/1983 | Kazumi et al. | 198/377 X |
| 4,539,790 | 9/1985 | Zamboni | 53/370 X |
| 4,823,536 | 4/1989 | Manservigi et al. | 53/234 X |
| 5,016,421 | 5/1991 | Ferrero | 53/370 X |
| 5,251,740 | 10/1993 | Spatafora et al. | 198/458 |
| 5,291,985 | 3/1994 | Spatafora et al. | 198/419.3 |
| 5,301,792 | 4/1994 | Spatafora et al. | 198/408 |
| 5,318,165 | 6/1994 | Spatafora et al. | 198/433 |
| 5,381,884 | 1/1995 | Spatafora et al. | 198/433 |
| 5,390,779 | 2/1995 | Spatafora et al. | 198/458 |
| 5,400,574 | 3/1995 | Spatafora et al. | 53/531 |
| 5,400,893 | 3/1995 | Spatafora et al. | 198/396 |

FOREIGN PATENT DOCUMENTS

| | | |
|---|---|---|
| 1485819 | 9/1977 | United Kingdom . |
| 2035253 | 6/1980 | United Kingdom . |

*Primary Examiner*—Linda Johnson
*Attorney, Agent, or Firm*—Oblon, Spivak, McClelland, Maier & Neustadt

[57] ABSTRACT

An operating unit, wherein a feed device with a number of transportation heads for respective products successively feeds the products along a curved path through an operating station where each product is engaged by a tool for performing a given operation on the product. The tool is fitted to a toolholder device by which it is fed through the operating station simultaneously with a respective product and along the same curved path along which the product travels.

19 Claims, 5 Drawing Sheets

OPERATING UNIT FOR HANDLING MOVING PRODUCTS

BACKGROUND OF THE INVENTION

The present invention relates to an operating unit for handling moving products.

Though employable in any technical field for performing one or more operations on moving products or objects in general, the present invention is particularly suitable for use in the confectionary industry, for "fantailing" the wrappings of products, especially sweets and similar, fed substantially continuously along a given path.

For this reason, the following description refers specifically, though purely by way of example, to a fantail forming unit of the type comprising a wrapping closing station; a feed device with a given number of transportation heads for feeding the closing station with respective products having a wrapping with at least one open end portion; and a closing device located at the closing station, for fantailing the open end portion of each wrapping, and comprising at least one tool consisting of a mechanical hand revolving about its axis.

Operating units of the aforementioned type are known to comprise step operated feed devices, the transportation heads of which are fed successively and in steps through the closing station where, in the event the wrappings present only one open end portion, a single operating hand successively engages the respective open end portions of the wrappings as the respective transportation heads are arrested at the closing station. In the event both the end portions of each wrapping are open, the closing station obviously presents two opposed operating hands.

A major drawback of known operating units of the aforementioned type is that, by virtue of being step operated, the operating speed of the units is relatively slow and totally inadequate for the wrapping machines currently available on the market.

In an attempt to overcome the above drawback, operating units have been devised featuring continuously operated feed devices, each transportation head of which presents a closing element moving with the head and in turn featuring at least one operating hand.

While enabling relatively fast operating speeds, continuously operated units of the above type are invariably expensive and unreliable due to the complex mechanical design of the feed devices and the number of components involved. Moreover, by virtue of the complex mechanical design of the feed devices, the areas in which the wrappings are actually fantailed are rendered substantially inaccessible, and any change in format economically unfeasible. In other words, continuously operated units of the above type are not only expensive and unreliable, but also provide solely for large-scale or mass production of only one type of product.

SUMMARY OF THE INVENTION

It is an object of the present invention to provide an operating unit designed to overcome the aforementioned drawbacks.

According to the present invention, there is provided an operating unit for handling moving products, the unit comprising an operating station for performing a given operation on said products; a feed device having a given number of transportation heads for respective said products, and designed to feed the products successively along a first given path through the operating station; and an operating device located at the operating station, for performing said operation on said products, and comprising at least one operating tool; characterized by the fact that said operating device also comprises drive means for moving said tool about a first axis according to a first given law of motion, and along a second, annular, path comprising an active portion substantially coinciding with said first path.

According to a preferred embodiment of the above unit, each transportation head moves about a second axis parallel to the first axis; drive means being provided for moving the transportation head according to a second law of motion, substantially similar to the first law of motion, as it travels along said first path.

The operating device also preferably comprises a given number of said tools substantially equally spaced about the first axis; the number of the tools being independent of the number of transportation heads.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
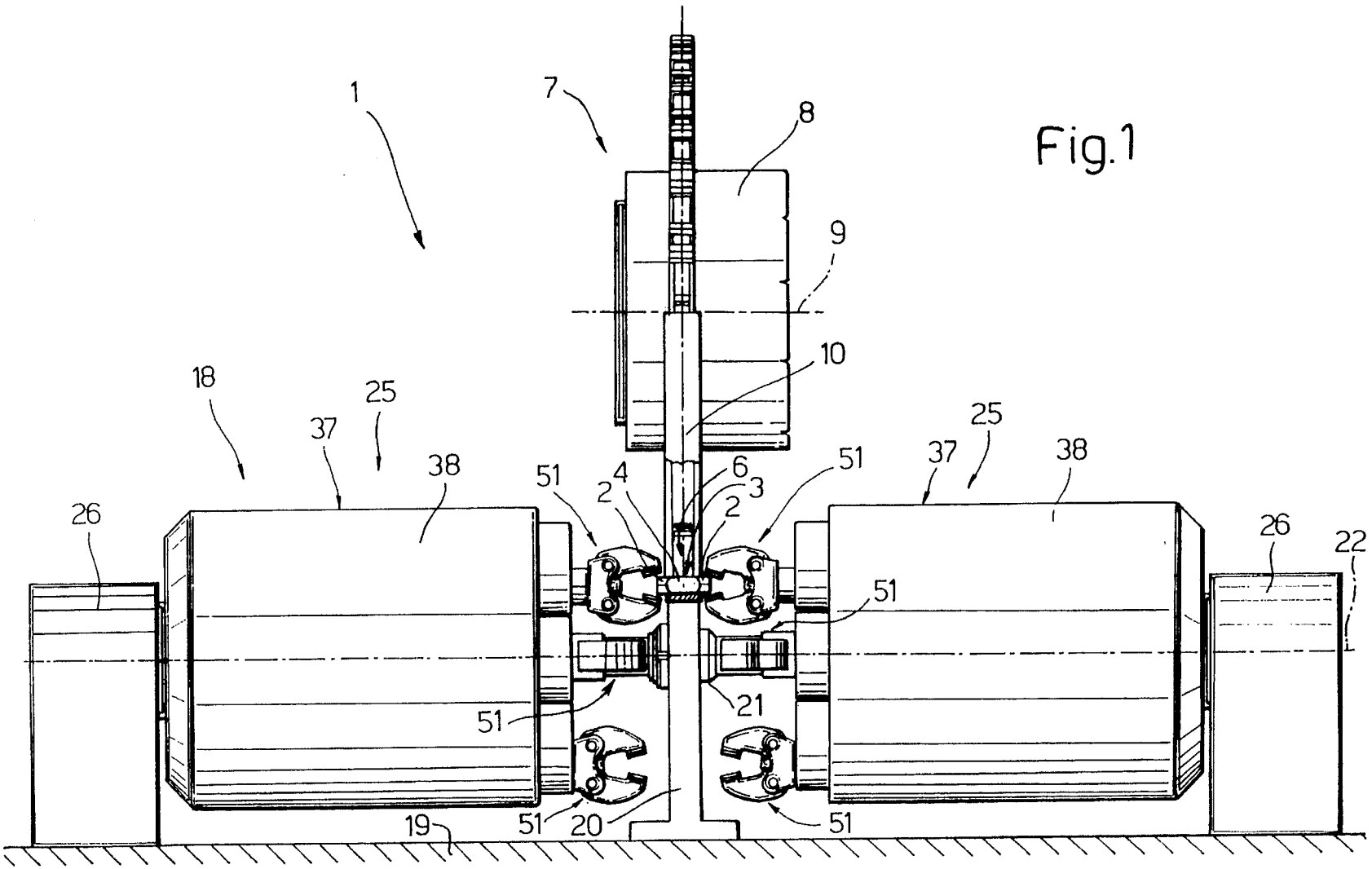
FIG. 1 shows a schematic plan view of a preferred embodiment of the operating unit according to the present invention.

Number 1 in FIG. 1 indicates an operating unit for performing an operation consisting in fantailing the two open end portions 2 of tubular wrappings 3 of a succession of sweets 4, by twisting portions 2 into respective fantails 5 (FIG. 2) at an operating station 6 for closing wrappings 3.

Figure 5:
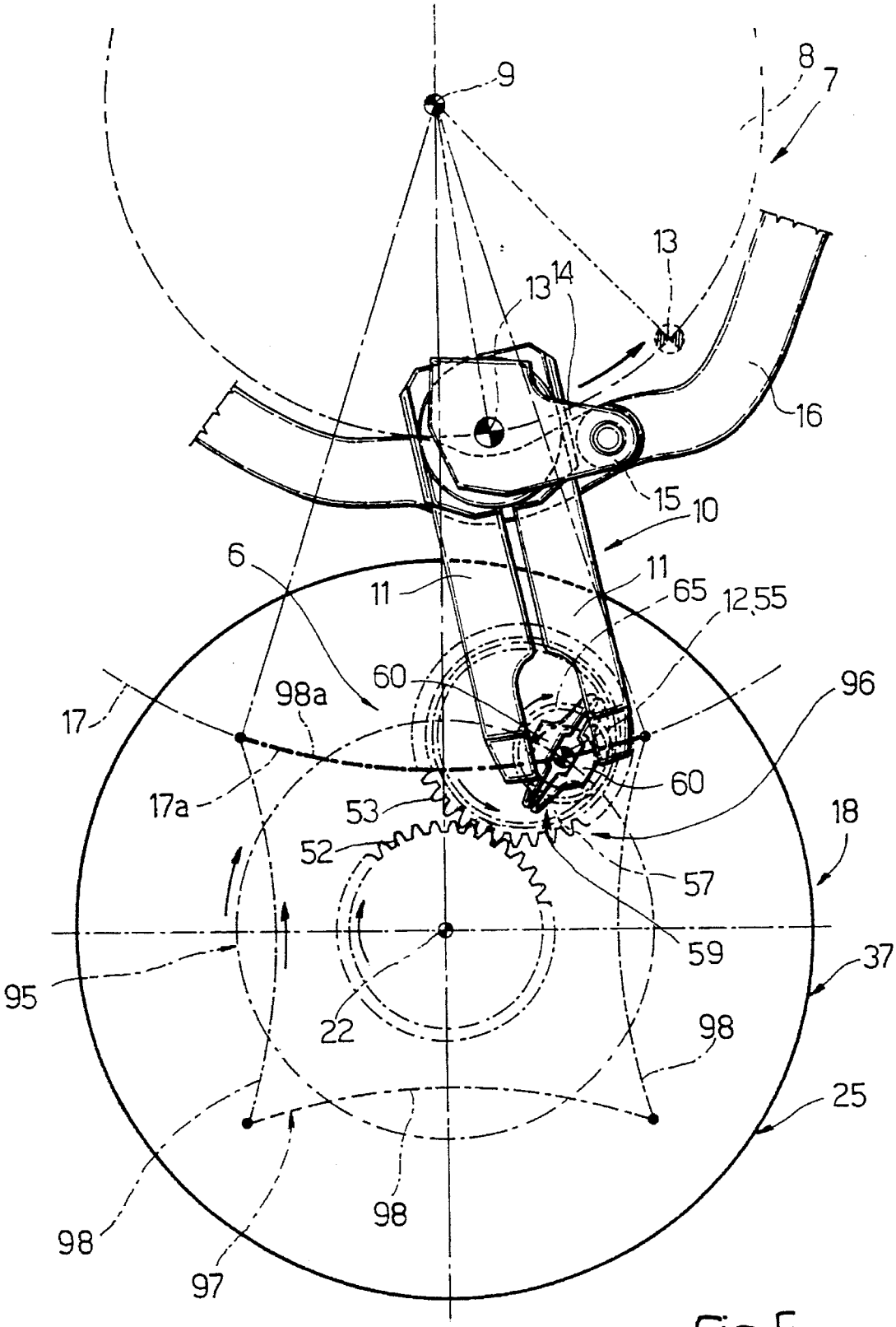
FIG. 5 shows an operating diagram relative to a particular instant in the operation of the FIG. 1 unit.

Unit 1 comprises a known feed device 7 in turn comprising a drum 8 supported on a fixed frame (not shown) and rotated by a drive shaft (not shown) at substantially constant speed and anticlockwise (in FIG. 5) about a substantially horizontal axis 9. From drum 8 there project substantially-radially outwards a number of transportation heads 10 equally spaced about drum 8 and each comprising (FIG. 5) two jaws 11 movable, via known actuating means (not shown), to and from a closed position in which they grip a sweet 4 positioned with its axis 12 parallel to axis 9 and having a respective wrapping 3. As shown in FIG. 5, each head 10 is fitted to drum 8 so as to rotate, in relation to drum 8, about a pivot 13, parallel to axis 9 and by virtue of the torque applied to head 10 by a lever 14 fitted on its free end with a tappet roller 15 moving along a fixed cam 16.

As it rotates about axis 9, drum 8 feeds sweets 4 successively along a substantially circular path 17 comprising a curved portion 17*a* extending through station 6 and along which sweets 4 are fed with a law of motion determined, at each instant, by the sum of a first speed vector due to rotation of drum 8 about axis 9, and a second speed vector due to rotation by cam 16 of respective head 10 about respective pivot 13, so that said law of motion may be varied in any way by simply varying the design of cam 16.

Unit 1 also comprises a closing device 18 at station 6, for fantailing each end portion 2 of each wrapping 3.

As shown in FIG. 1, closing device 18 comprises a fixed frame 19 integral with the frame (not shown) supporting drum 8, and having a fixed wall 20 extending perpendicular to axis 9 and coplanar with transportation heads 10. Wall 20 is located at station 6, and presents a free edge which, as shown particularly in FIG. 5, is skimmed by sweets 4 as they travel through station 6. Wall 20 constitutes the main bearing of a shaft 21 having an axis 22 parallel to axis 9 and mounted for rotation through a hole 23 in wall 20 via the interposition of a bearing 24. Shaft 21 is a central shaft for driving and synchronizing two identical closing elements 25 arranged specularly on either side of wall 20.

Both elements 25 are only required in the event wrappings 3 present two open end portions 2. If only one open end portion 2 is involved, one of elements 25 may be eliminated, for which purpose shaft 21 is formed in two parts connected by a removable joint at hole 23.

Figure 2:
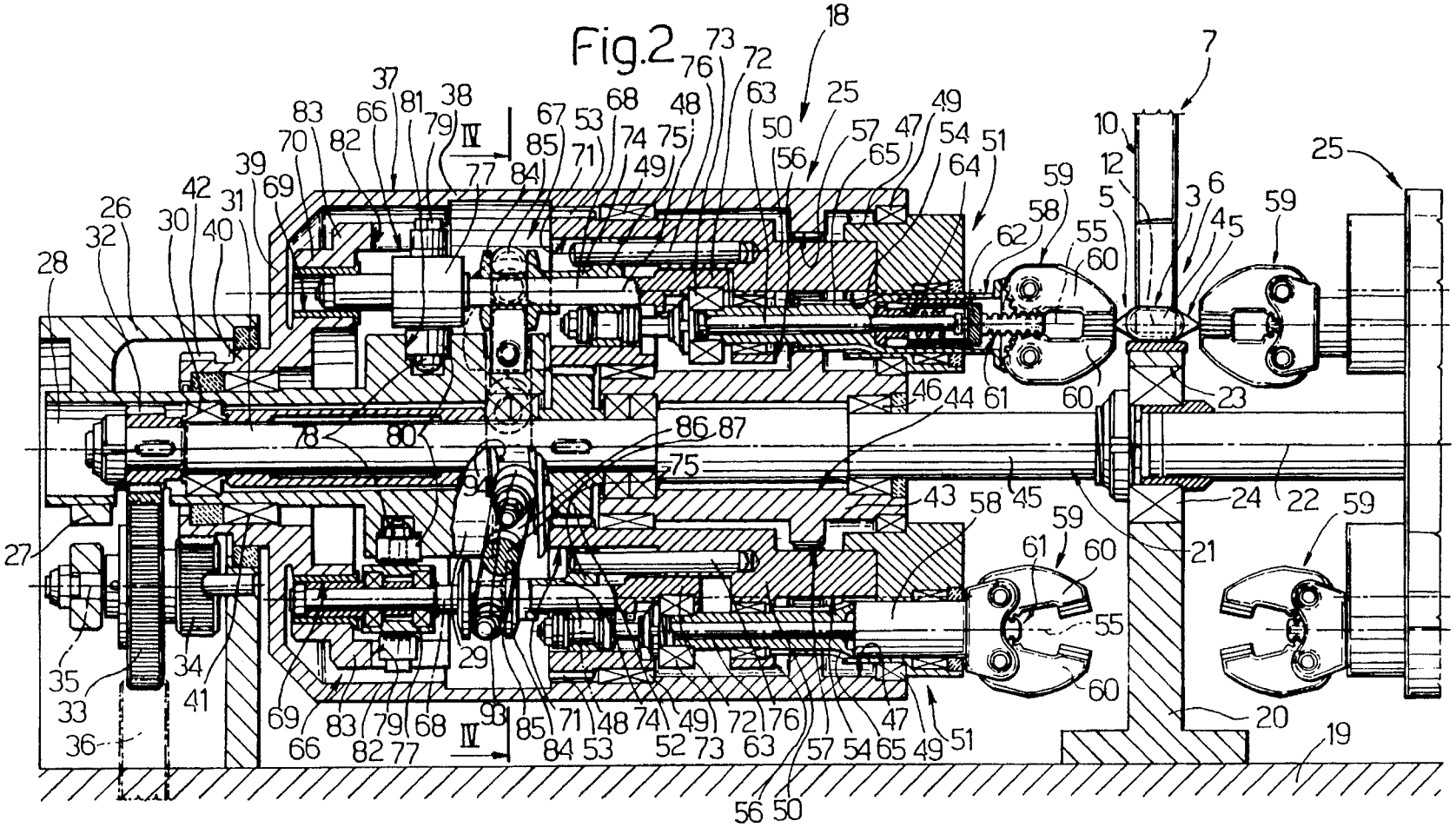
FIG. 2 shows a larger-scale axial section of a detail in FIG. 1.
Figure 3:
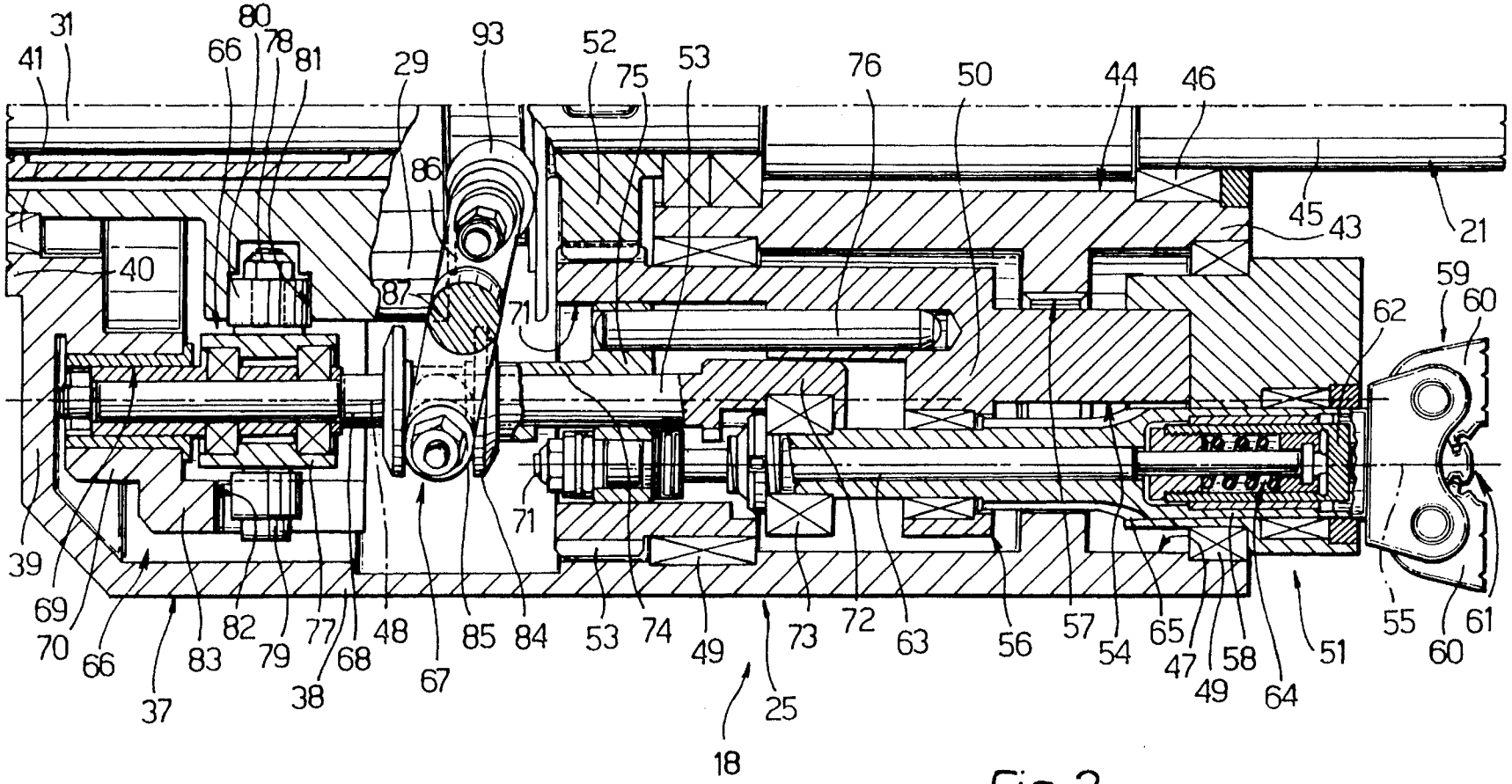
FIG. 3 shows a larger-scale detail of FIG. 2.

In view of the identical design of elements 25 and the fact that, as stated, one may be dispensed with, only one of elements 25 will be described below with reference to FIGS. 2 and 3.

Element 25 comprises a substantially U-shaped support 26 integral with and having its concavity facing frame 19. Support 26 presents an inner wall 27 through which is fitted a tubular body 28 coaxial with axis 22 and fitted integral with a fixed drum 29 on the end facing wall 20. Internally and via the interposition of a bearing 30, body 28 supports for rotation the free end portion 31 of shaft 21, and presents, inside support 26, an opening through which a gear 32, fitted to portion 31 of shaft 21, meshes with a first gear 33 of a reducer housed inside support 26 and comprising, in addition to gear 33, a second gear 34 smaller in diameter than gear 33. Gear 34 is coaxial with gear 33, and is mounted on support 26 so as to rotate with gear 33 about an axis 35 parallel to axis 22 and by virtue of a drive gear 36 meshing with gear 33 and synchronized, in known manner (not shown) and according to a given law, with the drive shaft (not shown) of drum 8.

Element 25 also comprises a bell 37 defined laterally by a cylindrical wall 38 coaxial with axis 22 and closed at one end by a wall 39 perpendicular to axis 22. Wall 39 presents a tubular axial appendix 40 facing support 26 and fitted through with body 28, which supports for rotation appendix 40 and bell 37 via the interposition of a bearing 41. An end portion of appendix 40 penetrates inside support 26 and is fitted with a gear 42 meshing with gear 34 for rotating bell 37 about axis 22 in the same direction as shaft 21, but at a slower speed by virtue of the smaller number of teeth on gear 34 as compared with gear 33.

At the end facing wall 20 and opposite to that featuring appendix 40, bell 37 is closed by a thick plate 43 having a central, substantially cylindrical through hole 44 coaxial with axis 22 and engaged in rotary manner by a further portion 45 of shaft 21 via the interposition of bearings 46. Plate 43 also presents four holes 47 having respective axes 48 parallel to and equally spaced about axis 22. Via the interposition of bearings 49, each hole 47 houses for rotation the cylindrical body 50 of a gripping device 51 rotated about respective axis 48 by a sun gear 52 formed on shaft 21 between plate 43 and drum 29 and meshing with a planetary gear 53 formed on the end of body 50 facing wall 38.

Each body 50 presents a hole 54 having an axis 55 parallel to and eccentric in relation to respective axis 48; and the central portion of each body 50 presents an opening 56 communicating laterally with hole 54 and engaged by a ring gear 57 formed on the inner surface of respective hole 47. Each hole 54 houses in rotary and axially-sliding manner the tubular, substantially cylindrical head 58 of a mechanical operating hand 59. In addition to head 58, hand 59 also comprises two opposed jaws 60 pivoting on the end of head 58 facing wall 20, and connected, by means of a rack and pinion drive 61, to a cup-shaped body 62 mounted in axially-sliding manner inside head 58 so as to move jaws 60 in opposite directions between an open position (bottom of FIG. 2) and a closed position (top of FIG. 2). Each hand 59 also comprises a shaft 63 coaxial with axis 55, mounted in axially-sliding manner through head 58, and connected at one end to respective body 62 via the interposition of an elastic axial joint 64. An intermediate outer surface portion of each head 58 presents teeth 65 meshing, through opening 56, with ring gear 57 so that, as body 50 is rotated inside respective hole 47, head 58 is rotated in the opposite direction about axis 55 by virtue of teeth 65 rolling along ring gear 57.

Finally, each hand 59 comprises a first actuating device 66 for cyclically moving respective head 58 axially along respective hole 54 towards wall 20, and between an idle withdrawn position (bottom of FIG. 2) and a forward gripping position (top of FIG. 2); and a second actuating device 67 for axially moving shaft 63 and body 62 in relation to head 58 and so moving jaws 60 between said open and closed positions.

Actuating devices 66 and 67 present a common shaft 68 coaxial with axis 48 and having a first end facing wall 39 and housed in rotary and axially-sliding manner inside a seat 69 formed through a plate 70 integral with wall 39; and a second end facing wall 20, housed in axially-sliding manner inside an axial cavity 71 on the end of body 50 facing wall 39, and fitted integral with a bracket 72 fitted axially and in rotary manner, via the interposition of a bearing 73 coaxial with axis 55, to the end of respective head 58 facing wall 39. Connection of bracket 72 and respective head 58—eccentric in relation to axis 48—provides for rendering shaft 68 and respective body 50 angularly integral with each other. Sliding connection of shaft 68 and body 50 at cavity 71 is assured by a sleeve 74 mounted in sliding manner on shaft 68 and presenting, on the end facing wall 20, a plate 75 through which are fitted an eccentric guide pin 76 housed inside cavity 71 and parallel to axis 48, and an end portion of shaft 63 fitted axially to plate 75.

The portion of shaft 68 between sleeve 74 and seat 69 engages in rotary and axially-fixed manner a cylindrical sleeve 77 forming part of actuating device 66 and having two radial pins 78 and 79, the first supporting in idle manner a tappet roller 80 moving inside a cam groove 81 formed on the outer surface of drum 29, and the second engaging in sliding manner a guide and angular lock opening 82 formed parallel to axis 22 on an appendix 83 of plate 70.

Figure 4:
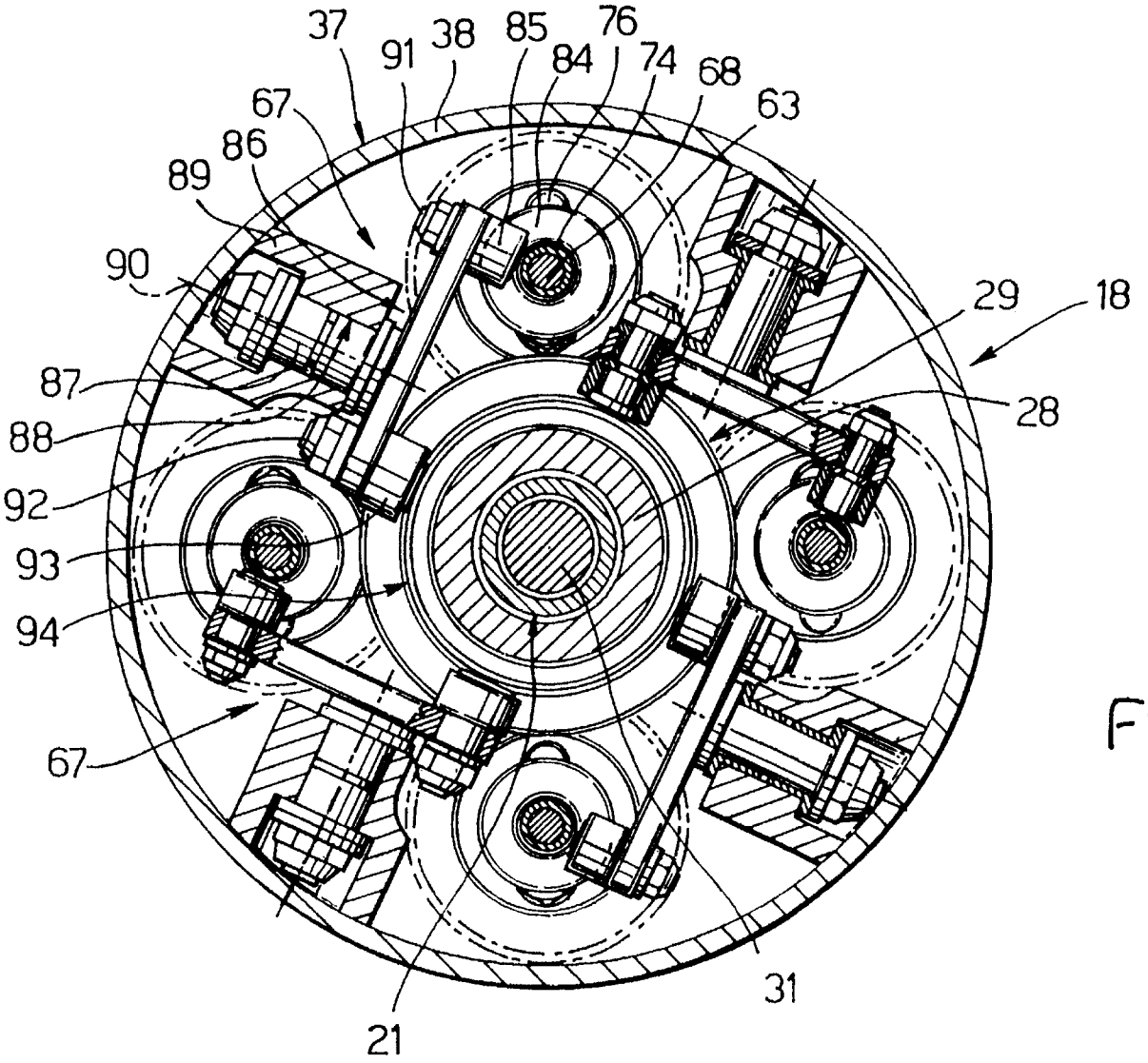
FIG. 4 shows a section along line IV—IV in FIG. 2.

The end portion of sleeve 74 opposite that with plate 75 presents an annular fork 84 engaged by a roller 85 constituting the output member of actuating device 67. As shown more clearly in FIG. 4, actuating device 67 comprises a rocker arm 86 having a central transverse hinge pin 87 fitted in rotary and axially-fixed manner through a hole 88 in a supporting body 89 integral with wall 38 of bell 37, and having an axis 90 substantially radial in relation to wall 38. Rocker arm 86 presents a first end fitted with a pin 91 parallel to axis 90 and supporting roller 85 in idle manner; and a second end fitted with a further pin 92 parallel to pin 91 and supporting in idle manner a further tappet roller 93 engaging a cam groove 94 formed on the outer surface of drum 29.

In actual use, gears 33 and 34, driven by gear 36, rotate shaft 21 and bell 37 clockwise in FIG. 5, and, by virtue of the different gear ratio, shaft 21 rotates about axis 22 at a greater speed as compared with bell 37.

As bell 37 rotates, axis 48 of each hole 47 travels, clockwise in FIG. 5, along a circular path 95 which, at closing station 6, intersects portion 17*a* of path 17 of sweets 4 at two points. Groove 81 is so designed that, for each turn of bell 37 about axis 22, each operating hand 59 moves between a forward position, assumed as it travels through station 6 and wherein jaws 60 are so positioned as to engage portion 2 of wrapping 3 of a respective sweet 4, and a withdrawn position assumed outside station 6. Groove 94 is so designed that, for each turn of bell 37 about axis 22, jaws 60 of each operating hand 59 move between a closed position, assumed as they travel through station 6 and wherein jaws 60 provide for gripping portion 2 of wrapping 3 of a respective sweet 4, and an open position assumed outside station 6.

As shown in FIG. 5, sun gear 52, planetary gears 53 and eccentric heads 58 on planetary gears 53 define a hypocyclic drive 96 which, for each turn of bell 37 about axis 22, moves each axis 55 about axis 22 along a substantially quadrangular path 97 having curved sides 98, the shape of which is a function of the eccentricity of axes 55 in relation to respective axes 48. More specifically, in the case of only a very small degree of eccentricity, the sides of path 97 present their respective concavities facing axis 22; and, as the eccentricity increases, the sides first become substantially straight and then curve increasingly towards axis 22.

By adjusting the eccentricity of axes 55 in relation to respective axes 48, therefore, a path 97 can always be found wherein one side 98*a*, extending through station 6, coincides with portion 17*a* of path 17. As the traveling speed of axes 55 along sides 98, instead of being constant, varies according to a given law of motion which is also a function, among other things, of the eccentricity of axes 55 in relation to respective axes 48, cam 16 must be so designed that axes 12 travel along portion 17*a* according to the same law of motion. In which case, it is sufficient to so synchronize the speed and operation of drum 8 and bell 37 that each hand 59 travels through station 6 together with a respective sweet 4, the open end portion 2 of wrapping 3 of which is gripped by jaws 60 at the input of station 6, and is twisted into a fantail as jaws 60 are rotated by respective teeth 65 rolling along respective ring gear 57.

The advantages of unit 1 as compared with the known state of the art will be clear from the foregoing description. In particular, closing devices 18 are fully independent of feed device 7; are extremely compact and relatively cheap; provide for full exposure and access to device 7, even at closing station 6; and may be changed easily, for servicing or different product sizes, with absolutely no alteration to feed device 7 with the exception of cam 16.

By virtue of the relatively light weight of devices 18, and the fact that each operating hand 59 accompanies sweet 4 part of the way through station 6, devices 18 may be rotated extremely rapidly, despite allowing sufficient time for fantailing the open end portions 2 of wrappings 3, and as such may be connected to high-speed feed devices 7, despite the number of gripping devices 51 differing from the number of transportation heads 10 on device 7. The fact that the number of gripping devices 51 is independent of transportation heads 10 enables closing devices 18 to be produced with a relatively small number of devices 51 for reducing production and maintenance costs.

I claim:

1. An operating unit for handling moving products, the unit comprising:

an operating station for performing a given operation on said products;

a feed device having a given number of transportation heads for respective said products and designed to feed the products successively along a first given path through the operating station;

an operating device located at the operating station for performing said operation on said products, the operating device comprising at least one operating tool and drive means for moving said operating tool along a second, annular path extending about a fixed first axis, said annular path comprising an active portion substantially coinciding with said first path, said drive means being a hypocyclic drive means designed to move said tool along said second path at a speed which is variable according to a first given law of motion, and comprising a carrier element mounted for rotation solely about said first axis and supporting said tool, wherein each of said transportation heads is movable about a second axis parallel to the first axis; and actuating means for moving each of the transportation heads at a speed which is variable according to a second law of motion, the second law of motion being substantially the same as the first law of motion, as the transportation heads travel along said first path.

2. A unit claimed in claim 1, wherein the operating device comprises a given number of said tools spaced with a variable pitch about the first axis, the number of said tools being independent of the number of said transportation heads.

3. A unit as claimed in claims 1 or 2, wherein said second path is a quadrangular path including two pairs of opposite sides, the sides of each said pair being arranged symmetrically in relation to said first axis, wherein one of said sides coincides with said first path.

4. A unit as claimed in claim 3, wherein said one side is curved so as to have a concavity facing outwards towards the second axis.

5. A unit as claimed in claim 3, wherein said hypocyclic drive means comprise, further to said carrier element, a sun gear coaxial with the first axis and, for each said tool, a planetary gear mounted on said carrier element for rotation about a third axis parallel to the first axis.

6. A unit as claimed in claim 5, wherein each said tool extends along a fourth axis parallel to the first axis, said drive means also comprising, for each said tool, a supporting body integral with the respective planetary gear and rotating with the planetary gear in relation to the carrier element and about the respective third axis, each said fourth axis being eccentric in relation to the respective third axis.

7. A unit as claimed in claim 6, wherein the unit is a fantail twisting unit for closing the ends of product wrappings, each wrapping presenting at least one open end portion, said operating station and said operating device being respectively a closing station and a closing device for fantail twisting said open end portion, and each said tool being a mechanical operating hand for forming the fantail and mounted for rotation about the respective fourth axis.

8. A unit as claimed in claim 7, wherein each said operating hand forms part of a respective gripping device comprising a respective said supporting body with a respective planetary gear, a gripping head fitted with the operating hand and mounted on the supporting body so as to move axially along the respective fourth axis and rotate about the fourth axis in relation to the supporting body, first actuating means for moving said gripping head and respective operating hand axially along the respective fourth axis and, in relation to the respective supporting body, between a forward operating position and a withdrawn idle position, second actuating means for moving the operating hand between an open and closed position, and third actuating means for rotating the operating hand about the respective fourth axis and in relation to the respective supporting body.

9. A unit as claimed in claim 8, wherein said first and second actuating means comprise respective first and second fixed cam means extending about the first axis.

10. A unit as claimed in claim 9, wherein said first and second cam means are common to all the gripping devices.

11. A unit as claimed in claim 8, wherein, for each said gripping head, said third actuating means comprise teeth formed on the gripping head coaxially with the respective fourth axis, and a ring gear engaged by said teeth and formed on the respective supporting body coaxially with the respective third axis.

12. A unit as claimed in claim 4, wherein said hypocyclic drive means comprise, further to said carrier element, a sun gear coaxial with the first axis and, for each said tool, a planetary gear mounted on said carrier element for rotation about a third axis parallel to the first axis.

13. A unit as claimed in claim 12, wherein each said tool extends along a fourth axis parallel to the first axis, said drive means also comprising, for each said tool, a supporting body integral with the respective planetary gear and rotating with the planetary gear in relation to the carrier element and about the respective third axis, each said fourth axis being eccentric in relation to the respective third axis.

14. A unit as claimed in claim 13, wherein the unit is a fantail twisting unit for closing the ends of product wrappings, each wrapping presenting at least one open end portion, said operating station and said operating device being respectively a closing station and a closing device for fantail twisting said open end portion, and each said tool being a mechanical operating hand for forming the fantail and mounted for rotation about the respective fourth axis.

15. A unit as claimed in claim 14, wherein each said operating hand forms part of a respective gripping device comprising a respective said supporting body with a respective planetary gear, a gripping head fitted with the operating hand and mounted on the supporting body so as to move axially along the respective fourth axis and rotate about the fourth axis in relation to the supporting body, first actuating means for moving said gripping head and respective operating hand axially along the respective fourth axis and, in relation to the respective supporting body, between a forward operating position and a withdrawn idle position, second actuating means for moving the operating hand between an open and closed position, and third actuating means for rotating the operating hand about the respective fourth axis and in relation to the respective supporting body.

16. A unit as claimed in claim 15, wherein said first and second actuating means comprise respective first and second fixed cam means extending about the first axis.

17. A unit as claimed in claim 16, wherein said first and second cam means are common to all the gripping devices.

18. A unit as claimed in claim 15, wherein, for each said gripping head, said third actuating means comprise teeth formed on the gripping head coaxially with the respective fourth axis, and a ring gear engaged by said teeth and formed on the respective supporting body coaxially with the respective third axis.

19. A unit as claimed in claim 1, wherein said operating tool includes a fourth axis and said drive means moves said fourth axis along said second path, at a speed which is variable according to the first given law.

* * * * *

UNITED STATES PATENT AND TRADEMARK OFFICE

CERTIFICATE OF CORRECTION

PATENT NO. : 5,481,849

DATED : Jan. 9, 1996

INVENTOR(S) : Mario SPATAFORA

It is certified that error appears in the above-indentified patent and that said Letters Patent is hereby corrected as shown below:

On the title page, Item [73], the Assignee, should read:

--Azionaria Costruzioni Macchine Automatiche A.C.M.A. S.p.A.--

Signed and Sealed this

Twenty-third Day of April, 1996

*Attest:*

*Attesting Officer*

BRUCE LEHMAN

*Commissioner of Patents and Trademarks*